US011930877B2

(12) United States Patent
Riegle et al.

(10) Patent No.: US 11,930,877 B2
(45) Date of Patent: Mar. 19, 2024

(54) HELMET

(71) Applicant: Xenith LLC, Lowell, MA (US)

(72) Inventors: Connor Riegle, Dearborn Heights, MI (US); Bailey Boyd, Ypsilanti, MI (US); Andrew Lark, Detroit, MI (US); Grant Goulet, Detroit, MI (US); Andrew Elliott, Royal Oak, MI (US); Kyle Lamson, Chelmsford, MA (US)

(73) Assignee: XENITH LLC, Lowell, MA (US)

( * ) Notice: Subject to any disclaimer, the term of this patent is extended or adjusted under 35 U.S.C. 154(b) by 335 days.

(21) Appl. No.: 17/289,131

(22) PCT Filed: Oct. 30, 2019

(86) PCT No.: PCT/US2019/058941

§ 371 (c)(1),
(2) Date: Apr. 27, 2021

(87) PCT Pub. No.: WO2020/092629

PCT Pub. Date: May 7, 2020

(65) Prior Publication Data

US 2021/0378343 A1 Dec. 9, 2021

Related U.S. Application Data

(60) Provisional application No. 62/752,808, filed on Oct. 30, 2018.

(51) Int. Cl.
*A42B 3/12* (2006.01)
*A42B 3/20* (2006.01)

(52) U.S. Cl.
CPC ..... *A42B 3/12* (2013.01); *A42B 3/205* (2013.01)

(58) Field of Classification Search
CPC ..... A42B 3/12; A42B 3/205; A42B 3/20
See application file for complete search history.

(56) References Cited

U.S. PATENT DOCUMENTS 5,893,174 A * 4/1999 Primeau ..... A42B 3/20 2/9
5,953,761 A * 9/1999 Jurga ..... A42B 3/328 2/420
6,189,156 B1 * 2/2001 Loiars ..... A42B 3/28 2/9
7,950,073 B2 5/2011 Ferrara
(Continued)

FOREIGN PATENT DOCUMENTS

CA 2784316 A1 10/2012

OTHER PUBLICATIONS

International Search Report and Written Opinion for International Patent Application No. PCT/US2019058941, 11 pages.

*Primary Examiner* — Tajash D Patel
(74) *Attorney, Agent, or Firm* — Morgan, Lewis & Bockius LLP

(57) ABSTRACT

A helmet may include a shell defining a cavity to receive a user's head. The shell may include a shell outer surface and a receiving area recessed into the shell outer surface. A liner may be within the cavity and coupled to the shell. A facemask may be coupled to the shell. A front bumper may be coupled to the shell and the liner. The front bumper may extend from within the cavity to an exterior of the shell. The front bumper may be positioned at least partially within the receiving area of the shell.

21 Claims, 18 Drawing Sheets

(56) References Cited

U.S. PATENT DOCUMENTS

| | | | | |
|---|---|---|---|---|
| 8,146,178 | B2 | 4/2012 | Maddux et al. | |
| 8,209,784 | B2 | 7/2012 | Nimmons | |
| 9,131,744 | B2 | 9/2015 | Erb et al. | |
| 9,289,024 | B2 | 3/2016 | Withnall et al. | |
| 9,743,702 | B2 * | 8/2017 | Warmouth | A42B 3/20 |
| 2015/0257471 | A1 * | 9/2015 | Warmouth | A42B 3/124<br>188/377 |
| 2016/0324247 | A1 * | 11/2016 | Warmouth | A42B 3/20 |
| 2021/0204631 | A1 * | 7/2021 | Pahlmeyer | A42B 3/20 |

* cited by examiner

HELMET

CROSS REFERENCE TO RELATED APPLICATIONS

This application is a U.S. National Phase of International Application No. PCT/US2019/058941 filed on Oct. 30, 2019, which claims the benefit of U.S. Provisional Patent Application No. 62/752,808 filed Oct. 30, 2018 entitled "Helmet", each of which is incorporated by reference herein in its entirety.

FIELD OF THE INVENTION

The present invention generally relates to protective headgear and, more particularly, to a football helmet.

BRIEF SUMMARY OF THE INVENTION

In one embodiment, a helmet includes a shell defining a cavity to receive a user's head. The shell may include an exterior shell surface and a receiving area recessed into the exterior shell surface. A liner may be within the cavity and detachably coupled to the shell. A facemask may be coupled to the shell. A front bumper may be coupled to the shell and the liner. The front bumper may be coupled to an exterior of the shell. The front bumper may extend from within the cavity to an exterior of the shell. The front bumper may be positioned at least partially within the receiving area of the shell.

The shell may include a first ridge and a second ridge extending away from a rear surface of the shell. A rearmost point of the first ridge and a rearmost point the second ridge may lie within a reference plane that is rearwardly spaced from the rear surface of the shell when the helmet is resting on a horizontal surface. Each end of the first ridge may be curved upwardly toward a top of the shell and each end of the second ridge may be curved downward toward a bottom of the shell. The shell may include a first opening proximate each end of the first ridge and a second opening proximate each end of the second ridge. The first openings and the second openings may be arranged to form a generally X-shaped pattern. The front bumper may be positioned within the receiving area such that an outer surface of the front bumper is generally flush with the exterior shell surface.

The front bumper may be positioned within the receiving area such that an outer surface of the front bumper is recessed toward a center of the shell relative to the exterior shell surface. The front bumper may include a recess configured to receive at least a portion of the facemask. The front bumper may be positioned within the receiving area such that a top edge of an outer surface of the front bumper is flush with a top edge of the receiving area. The front bumper abuts an edge of the receiving area. The front bumper may be spaced from an edge of the receiving area. The front bumper may be detachably coupled to each of the shell and the liner.

The exterior shell surface may include a first side portion, a second side portion and a central portion extending between the first side portion and the second side portion. The exterior shell surface going from the first side portion to the central portion may be recessed and the exterior shell surface going from the second side portion to the central portion may be recessed. An apex of the central portion may be the top most element of the shell when the helmet is resting on a horizontal surface.

The exterior shell surface may include a rear portion, a front portion, a first side portion, a second side portion and a central portion extending from the front portion to the rear portion and between the first side portion and the second side portion. A perimeter of the central portion may be recessed relative to the first side portion and the second side portion proximate the front portion and protrudes relative to the first side portion and the second side portion proximate the rear portion.

In a further embodiment, each side portion of the shell includes a recessed area and the helmet includes a chin protector coupled to the recessed area of the shell by a chin protector fastener. The liner may be detachably coupled to each of the shell and the front bumper such that the liner can be detached from the shell and the front bumper while the front bumper remains coupled to the shell. The liner may be detachably coupled to the shell. The shell may be comprised of nylon.

In a further embodiment, a football helmet includes a shell, four openings in the rear of the shell, a liner, a facemask, a chin protector, two rear ridges, and a front bumper. The shell may define a cavity configured to receive a user's head. The shell may include a shell outer surface and a receiving area recessed into the shell outer surface. The four openings in the rear of the shell may allow the shell to flex when impacted. The liner may be within the cavity and coupled to the shell. The facemask may be coupled to the shell. The chin protector may include a strap coupled to a recessed area of the shell. The two rear ridges may protrude from a rear surface of the shell, the two rear ridges may be the rearmost element of the helmet. The front bumper may be detachably coupled to the shell and the liner. The front bumper may extend from within the cavity to an exterior of the shell and the front bumper may be positioned at least partially within the receiving area of the shell.

In a further embodiment, a football helmet includes a shell defining a cavity configured to receive a user's head. The shell may include an exterior shell surface and a receiving area recessed into an outer surface of the shell. The football helmet may include four openings in the rear of the shell that allow the shell to flex when impacted. A liner may be within the cavity and coupled to the shell. A facemask may be coupled to the shell. A chin protector may include a strap coupled to a recessed area of the shell. Two rear ridges may protrude from a rear surface of the shell, the two rear ridges being the rearmost element of the helmet. A front bumper may be detachably coupled to the shell and the liner, the front bumper extending from within the cavity to an exterior of the shell. The front bumper may be positioned at least partially within the receiving area of the shell such that an outer surface of the front bumper is generally flush with the exterior shell surface and the front bumper abuts an edge of the receiving area. The front bumper may include a recess that receives at least a portion of the facemask.

The exterior shell surface may include a rear portion, a front portion, a first side portion, a second side portion and a central portion extending from the front portion to the rear portion and between the first side portion and the second side portion. A perimeter of the central portion may be recessed relative to the first side portion and the second side portion proximate the front portion and protrudes relative to the first side portion and the second side portion proximate the rear portion. The liner may be detachably coupled to each of the shell and the front bumper such that the liner can be detached from the shell and the front bumper while the front bumper remains coupled to the shell.

BRIEF DESCRIPTION OF THE SEVERAL VIEWS OF THE DRAWINGS

The following detailed description of embodiments of the helmet will be better understood when read in conjunction with the appended drawings of an exemplary embodiment. It should be understood, however, that the invention is not limited to the precise arrangements and instrumentalities shown. For example, although not expressly stated herein, features of one or more various disclosed embodiments may be incorporated into other of the disclosed embodiments.

In the drawings.

DETAILED DESCRIPTION OF THE EXEMPLARY EMBODIMENTS OF THE INVENTION

Figure 1:
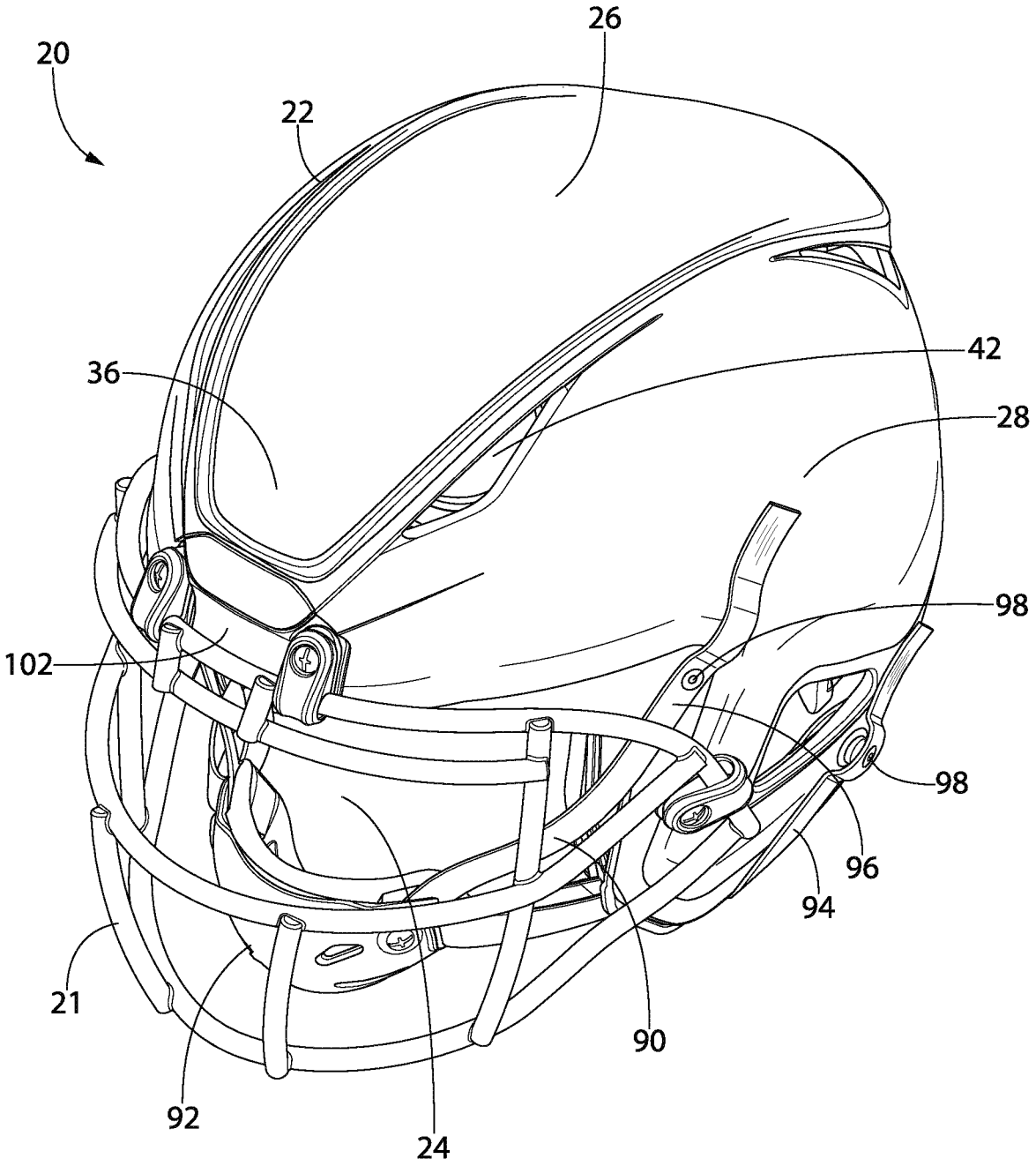
FIG. 1 is a front perspective view of a helmet in accordance with an exemplary embodiment of the present invention.
Figure 2:
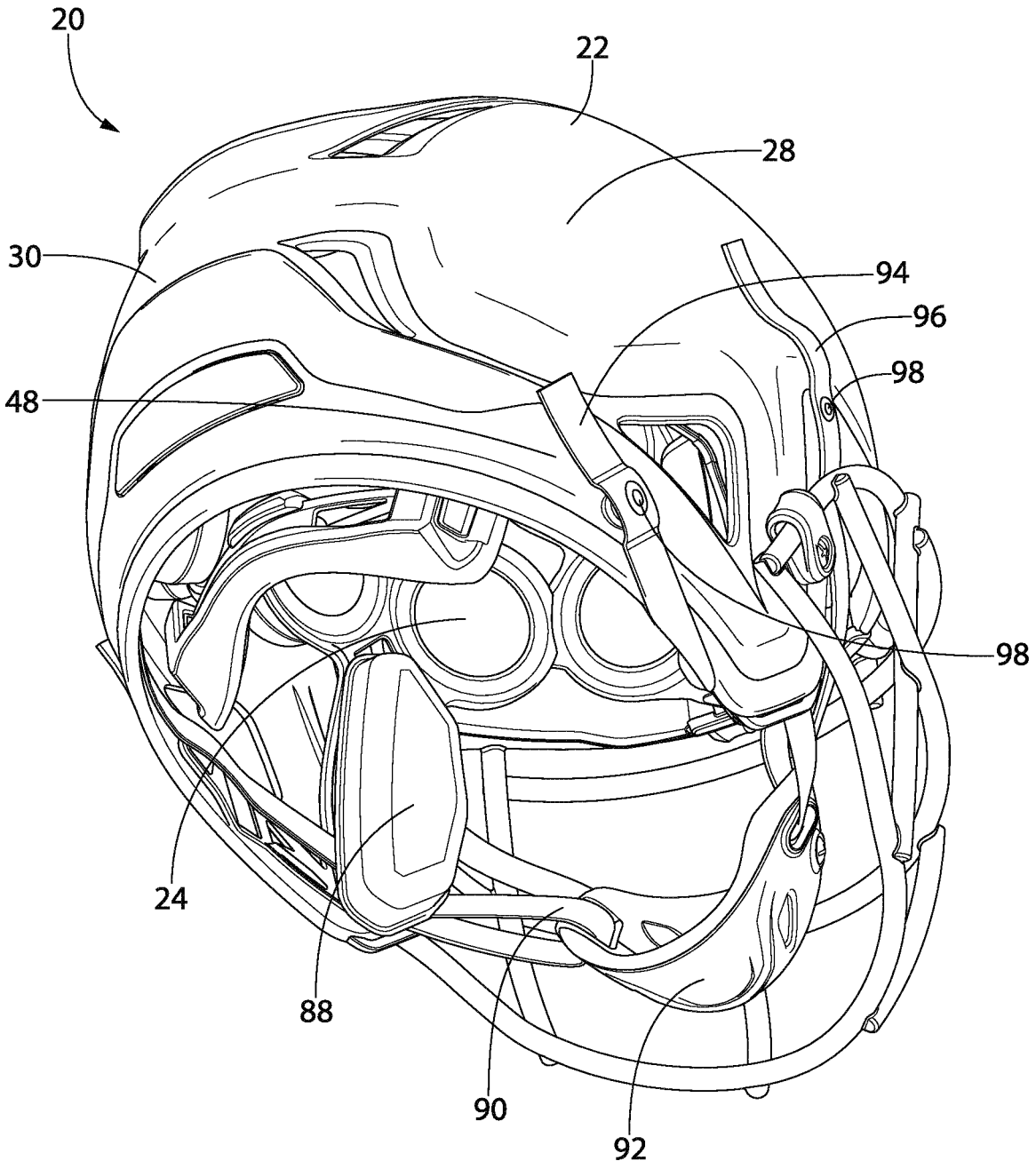
FIG. 2 is a bottom perspective view of the helmet of FIG. 1.

Protective helmets are used for contact sports, such as football, hockey, and lacrosse, and are also worn by people in military, construction, police, and firefighters. Protective helmets typically include a rigid outer shell, a pad assembly within the shell, a face guard or facemask, and a chin protector or strap that removably secures the helmet on the wearer's head. Helmets are designed to reduce the force of impact felt by a user when the helmet contacts another object such as the ground or another player. Increasing the thickness of the pad assembly or shell may help to reduce the force of impact felt by the user but may also increase the weight of the helmet leading to fatigue when the helmet is worn for an extended period.

The helmet described herein may decrease the force of impact felt by the user. Some portions of the helmet may be closer to the center of the helmet to lower the center of gravity of the helmet, thereby reducing user fatigue when wearing the helmet. The helmet may include a pad assembly with pads detachably coupled to a liner within the helmet. The pad assembly may include pads having a different design, thickness, or performance characteristic from other pads in the pad assembly. The shell may have recessed areas where the chin strap, front bumper, or facemask are coupled to the shell to reduce or eliminate points that could snag on other players or equipment.

Referring to the drawings in detail, wherein like reference numerals indicate like elements throughout, there is shown in FIGS. 1-18 a helmet, generally designated 20, in accordance with an exemplary embodiment of the present invention. In some embodiments, the helmet 20 is a football helmet.

The helmet 20 may meet or exceed selected National Operating Committee on Standards for Athletic Equipment ("NOCSAE") certification standards for helmets (e.g., NOCSAE ND002). The facemask 21 may meet or exceed selected certification standards for facemasks (e.g., NOCSAE ND087). The helmet 20 may perform better than existing helmets when subjected to one or more of Virginia Tech Adult Football STAR Methodology, Virginia Tech Youth Football Helmet STAR Methodology, or NFL Linear Impactor Helmet Test Protocol. The helmet 20 may meet or exceed requirements for pneumatic ram testing. Pneumatic ram testing may include measuring rotational forces and linear forces as measure by a headform within the helmet. Pneumatic ram testing may include placing helmet 20 on a headform mounted onto a linear bearing table and impacting the helmet 20 with a pneumatic ram at a selected velocity (e.g., 19.6 meters per second) on six different locations, including one random location in accordance with NOCSAE standards.

The helmet 20 may include a shell 22 configured to resist impacts. The shell 22 may be manufactured from polycarbonate, ABS, PC-ABS, nylon, or polyethylene. In some embodiments, the shell 22 is configured to flex when impacted to absorb some or all of the force of the impact, thereby reducing the force felt by the user. In other embodiments, the shell 22 is rigid. The shell 22 may define a cavity 24 configured to receive a user's head (not shown).

Figure 4:
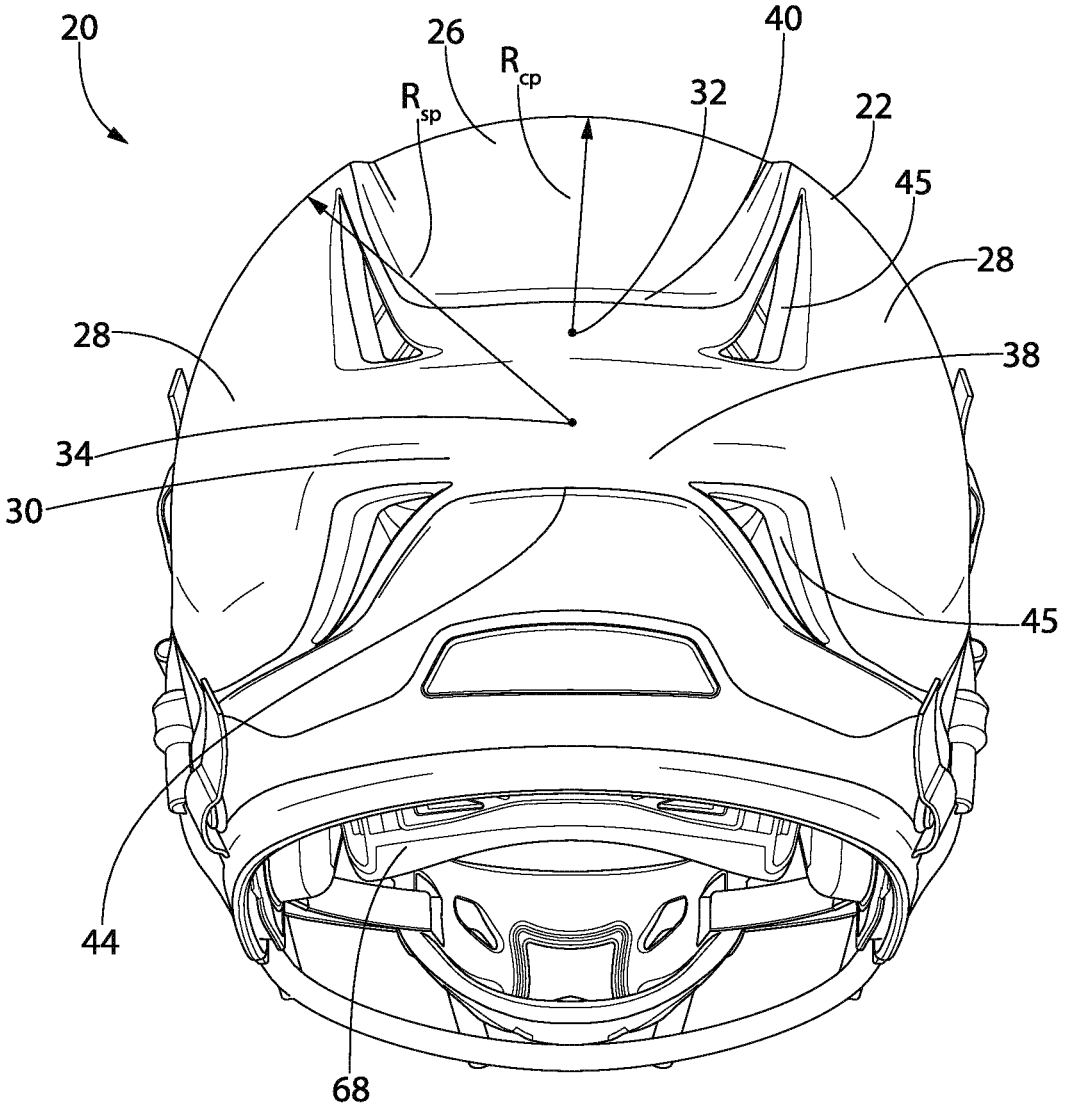
FIG. 4 is a rear elevation view of the helmet of FIG. 1.

Referring to FIGS. 1 and 4, the shell 22 may include a central portion 26 configured to be positioned adjacent a top and/or forehead of a user's head when the user's head is in the cavity 24. At least part of the central portion may have an arcuate shape with a central portion radius $R_{cp}$ (FIG. 4) measured from a radial center point 32. The shell 22 may include a side portion 28 configured to be positioned adjacent a side of the user's head and a rear portion 30 configured to be positioned adjacent a rear of the user's head. The shell 22 may be manufactured from a rigid material such that the splines defining the shape of the central portion 26 and the side portion 28 retain their shape when a force is applied to the shell 22. At least part of the side portion 28 (e.g., the part of the side portion adjacent the central portion) may have an arcuate shape with a side portion radius $R_{sp}$ (FIG. 4) measured from central point 34.

In some embodiments, the side portion 28 is defined by a single side portion radius $R_{sp}$. In other embodiments, the side portion 28 is defined by a first arcuate portion having a first radius and transitions to a second arcuate portion having a second radius. The first radius may be different than the second radius. In some embodiments, the first arcuate portion is directly adjacent the second arcuate portion. In other embodiments, a transition area is between the first arcuate portion and the second arcuate portion. The transition area between the first arcuate portion and the second arcuate portion may be a straight portion, an angled portion, or a stepped portion.

In some embodiments, the side portion radius $R_{sp}$ is greater than the central portion radius $R_{cp}$. In other embodiments, the side portion radius $R_{sp}$ is less than the central portion radius $R_{cp}$. In still other embodiments, the side portion radius $R_{sp}$ is equal to the central portion radius $R_{cp}$.

Referring to FIG. 1, an outer surface of the side portion 28 may be further from a center of the helmet 20 than an outer surface of the central portion 26. The average distance of the central portion 26 to the center of the helmet 20 may be smaller than the average distance of the side portion 28 to the center of the helmet 20. The central portion 26 being closer to the center of the helmet 20 may help to lower the center of gravity of the helmet 20. The outer surface of the central portion 26 at the front 36 of the helmet 20 may be closer to the center of the helmet 20 than the outer surface of the side portion 28 at the front 36 of the helmet 20. The outer surface of the top of the central portion 26 and the outer surface of the top of the side portion 28 may be coplanar. The outer surface of the side of the central portion 26 and the outer surface of the top of the side portion 28 may be coplanar.

The outer surface of the top of the central portion 26 may extend upwardly further than the outer surface of the top of the side portion 28. The outer surface of the top of the side portion 28 may extend upwardly further than the outer surface of a side of the central portion 26. The outer surface of the top of the central portion 26 may extend upwardly further than the outer surface of the top of the side portion 28 even when a side of the central portion 26 does not extend upwardly further than the outer surface of the top of the side portion 28. Extending upwardly may refer to when the helmet 20 is held with a crown of the helmet facing upwardly.

The shell 22 may include one or more first openings 42 in at least one of the side portion 28 and the central portion 26. The first opening 42 may extend through the shell 22 such that air or heat can vent through the opening. The first opening 42 may reduce the rigidity of the shell 22 in localized areas such that some portions of the shell 22 flex while other areas remain rigid. Allowing some portions of the shell 22 to flex may help to absorb some force of impact or reduce the force felt by the user. The first opening 42 may have a triangular shape. A triangular shaped first opening 42 may provide benefits over an opening having a different shape. In some embodiments, a triangular shaped first opening 42 may allow a larger opening to be adopted while reducing or minimizing the chance of a hand or finger entering the opening compared to openings of other shapes. A triangular shaped first opening 42 may include a major axis and a minor axis. The minor axis of the first opening 42 may limit the size of the opening at any particular cross-section along its length. The shell 22 may include at least two first openings 42 symmetrically positioned about a centerline of the shell 22.

Figure 5:
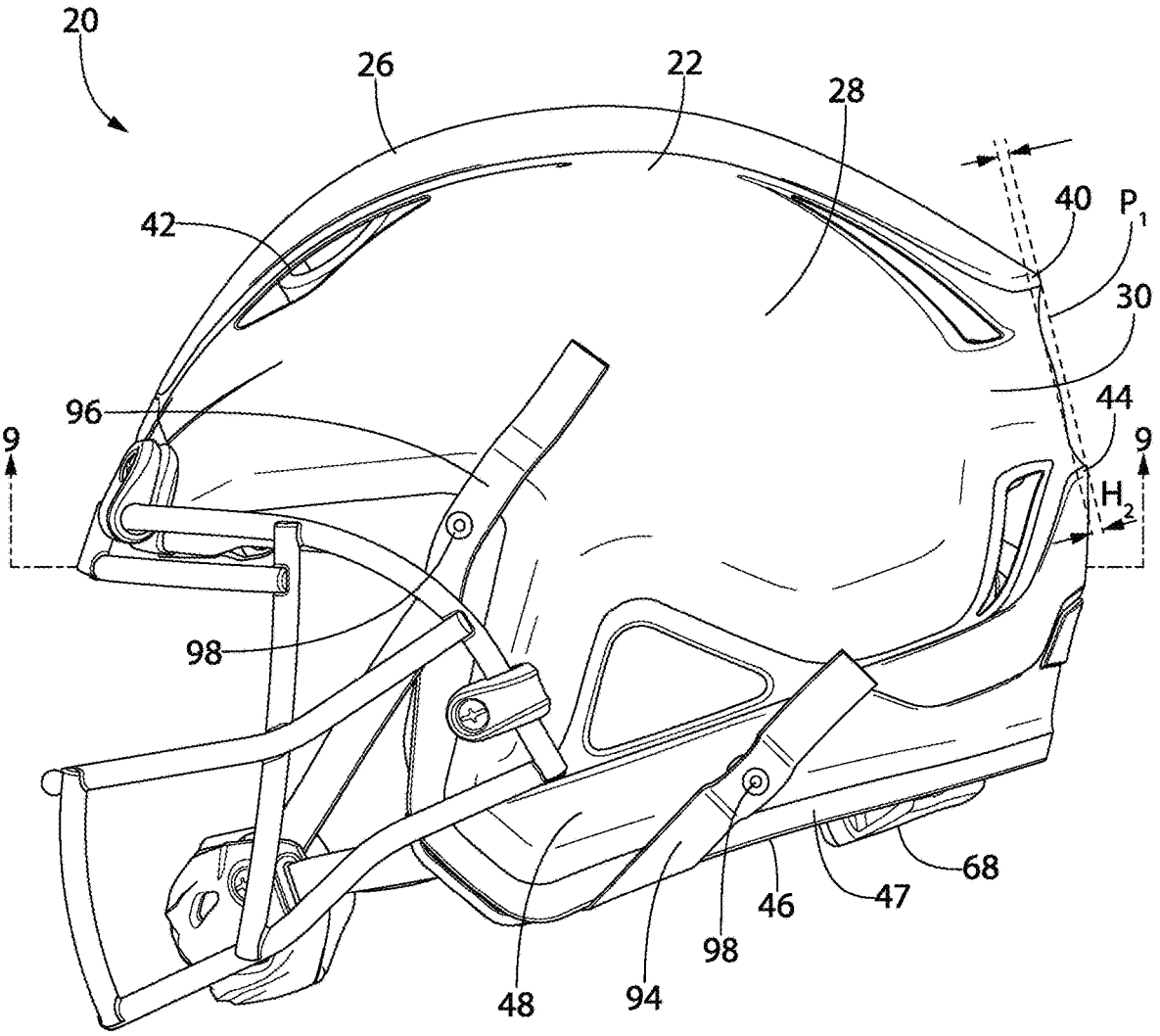
FIG. 5 is a side elevation view of the helmet of FIG. 1.
Figure 6:
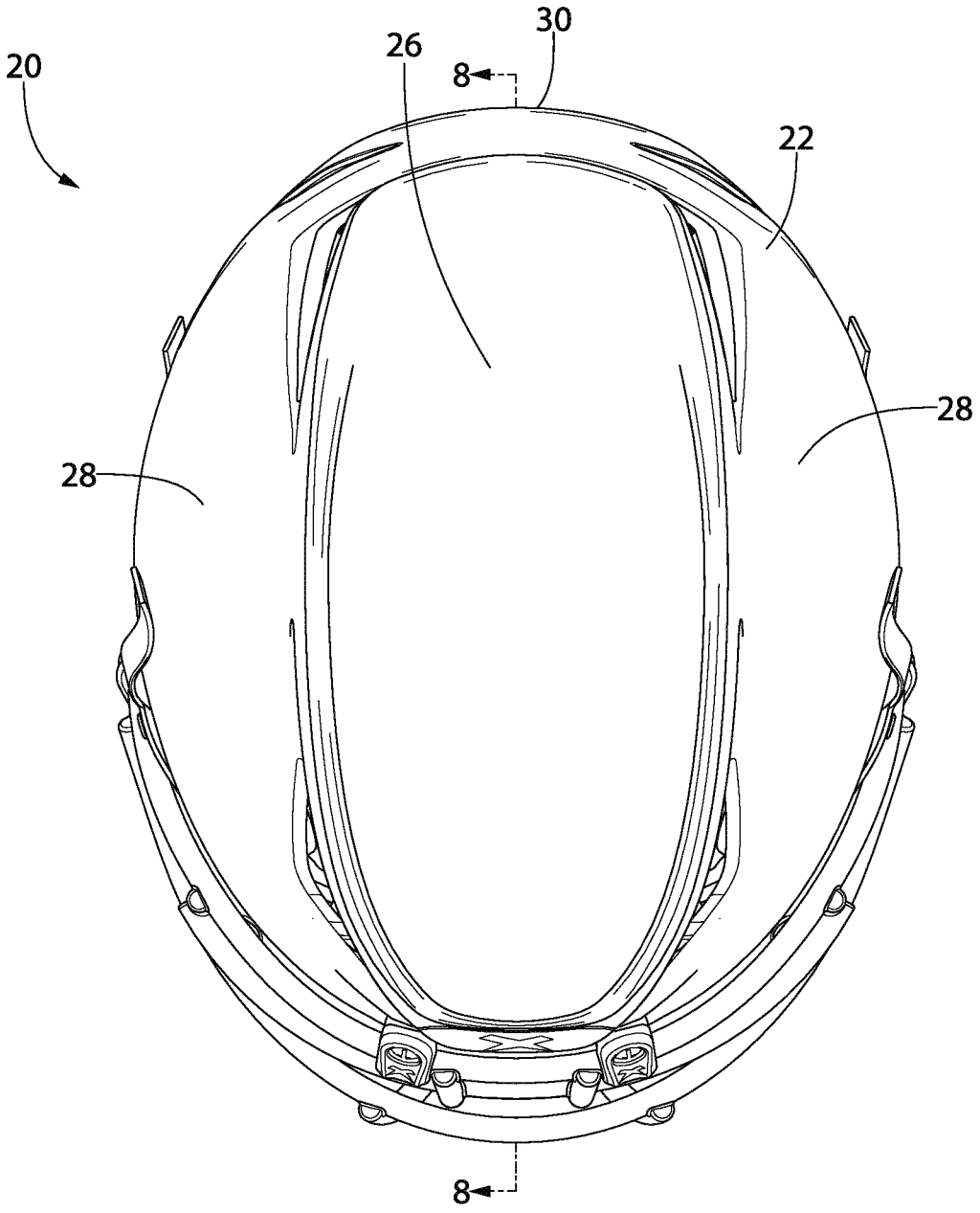
FIG. 6 is a top plan view of the helmet of FIG. 1.
Figure 7:
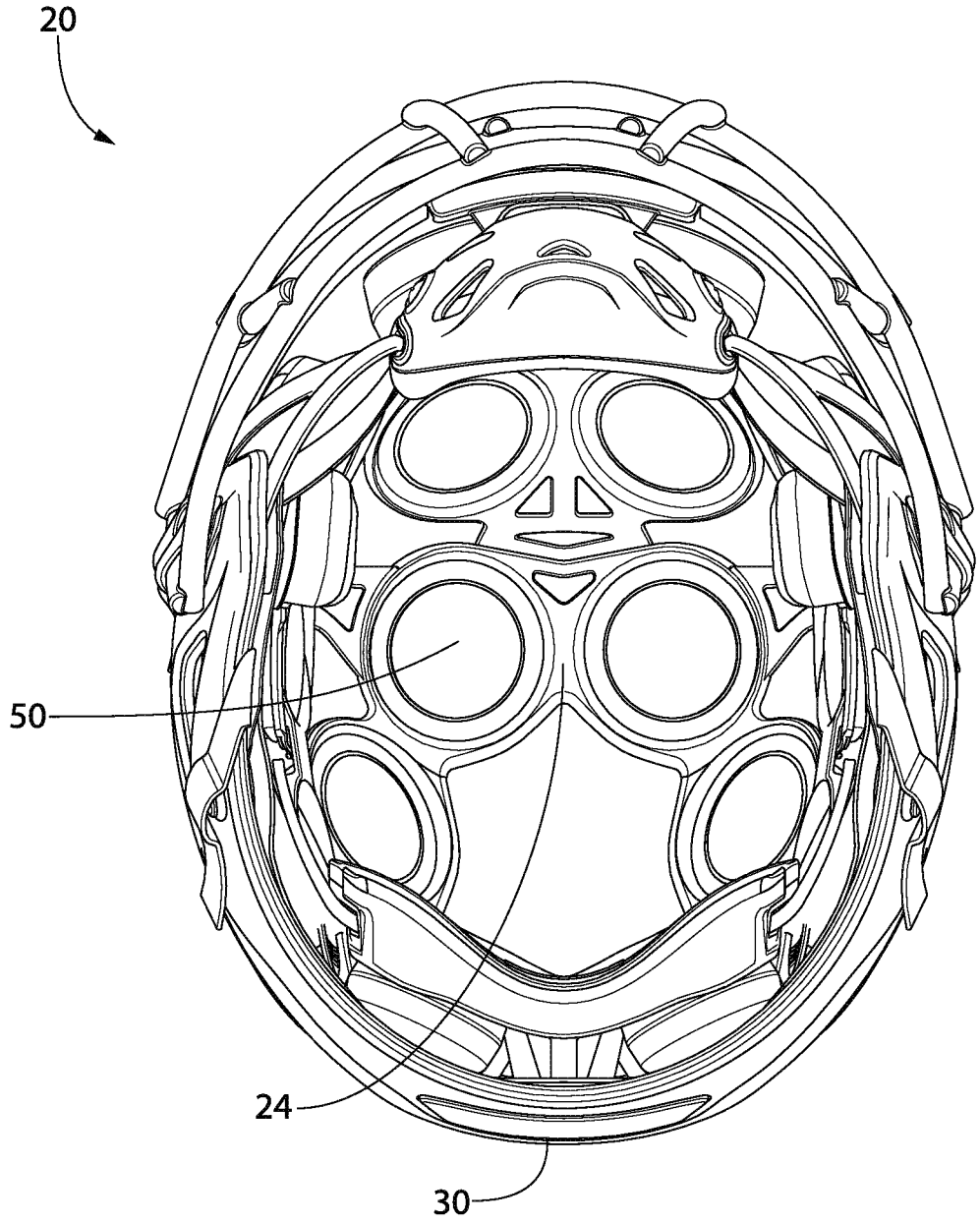
FIG. 7 is a bottom plan view of the helmet of FIG. 1.

Referring to FIGS. 1, 4, and 5, the central portion 26 may extend from a front 36 of the helmet 20 toward a rear 38 of the helmet 20. The rear part of the central portion 26 may extend rearwardly further than the rear portion 30 of the shell 22. A first ridge 40 may be located where the central portion 26 meets the rear portion 30. The first ridge 40 may have a height $H_1$ that is the distance that the first ridge 40 extends away from an outer surface of the rear portion 30. Height $H_1$ may be about 2 millimeters to about 30 millimeters, about 1 millimeter to about 5 millimeters, about 5 millimeters to about 10 millimeters, about 10 millimeters to about 15 millimeters, about 15 millimeters to about 20 millimeters, about 20 millimeters to about 25 millimeters, or about 25 millimeters to about 30 millimeters. The first ridge 40 may at least partially define a border between the central portion 26 and the rear portion 30 of the shell 22.

Referring to FIGS. 4 and 5, a second ridge 44 may protrude from the outer surface of the rear portion 30. The second ridge 44 may have a height $H_2$ that is the distance that the second ridge 44 extends away from the outer surface of the rear portion 30. Height $H_2$ may be about 2 millimeters to about 30 millimeters, about 1 millimeter to about 5 millimeters, about 5 millimeters to about 10 millimeters, about 10 millimeters to about 15 millimeters, about 15 millimeters to about 20 millimeters, about 20 millimeters to about 25 millimeters, or about 25 millimeters to about 30 millimeters. The second ridge 44 may extend from the rear portion 30 onto the side portion 28. The second ridge 44 may be closer to a bottom edge 46 of the shell 22 than the first ridge 40. The distance between the second ridge 44 and the first ridge 40 may be greater than the distance between the second ridge 44 and the bottom edge 46 of the shell 22.

In some embodiments, the height $H_2$ of the second ridge 44 is greater than the height $H_1$ of the first ridge 40. In other embodiments, the height $H_2$ of the second ridge 44 is less than the height $H_1$ of the first ridge 40. In still other embodiments, the height $H_2$ of the second ridge 44 is equal to or within 10% of the height $H_1$ of the first ridge 40. One of the first ridge 40 and the second ridge 44 may be the most rearward element of the helmet 20. The first ridge 40 and second ridge 44 may be the only elements that contact a surface (e.g., the ground) when the rear 38 of the helmet 20 is place in contact with the surface. The second ridge 44 may be the rearmost element of the shell 22 even when height $H_1$ is greater than height $H_2$. At least one of the first ridge 40 and the second ridge 44 may flex when contacted by an external object (e.g., another player or the ground) to absorb the force of impact.

Referring to FIG. 5, a portion of the first ridge 40 (e.g., the peak of the first ridge 40) and a portion of the second ridge 44 (e.g., the peak of the second ridge 44) may lie within a plane $P_1$. The plane $P_1$ may be the rear most portion of the helmet 20. Plane $P_1$ may be rearwardly spaced from the rear of the shell 22.

Referring to FIG. 4, one or more second openings 45 may be formed in one or more of the rear portion 30 and the central portion 26. The second openings 45 may allow portions of the shell 22 to flex when contacted, thereby absorbing some or all of the force of an impact. The second openings 45 may isolate flexing of the shell 22 to certain areas of the shell 22 when impacted. At least a portion of one or more of the first openings 40 and second openings 45 may be positioned between the first ridge 40 and the second ridge 44. The first ridge 40, the second ridge 44, and the second openings 45 may help lower the center of gravity of the helmet 20, thereby increasing user comfort and reducing fatigue when wearing the helmet 20.

Still referring to FIG. 4, the second openings 45 may be oriented in an overall X shaped pattern. The second openings 45 may have a triangular shape and the hypotenuse of the second openings 45 may define an X shaped pattern. The second openings may have a triangular shape and the hypotenuse of the second openings 45 may be closer to a vertical centerline of the shell 22 than the legs of the triangular second openings 45. The top second openings 45 may widen as they extend from front to back. A sidewall of the top second openings 45 may slant toward a centerline (e.g., a front to back centerline) of the shell 22 as the top second openings 45 extend from front to back. The bottom second openings 45 may widen as they extend from back to front. A sidewall of the bottom second openings 45 may slant toward the centerline of the shell 22 as the bottom second openings 45 extend from back to front. The first ridge 40 and second ridge 44 may have opposing U-shapes. The second openings 45 may define partial vents on each side of the U shaped ridges.

Figure 18:
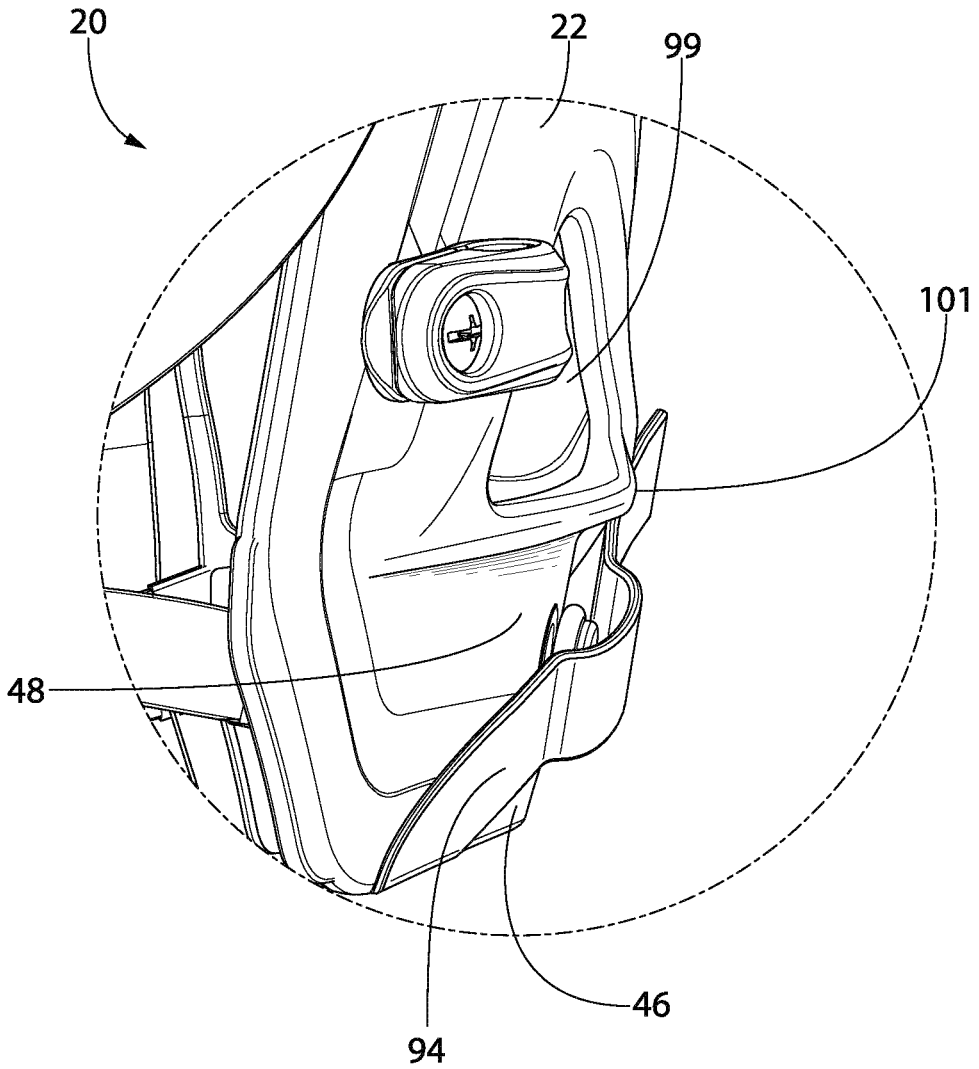
FIG. 18 is an enlarged perspective view of a portion of the helmet of FIG. 5.

Referring to FIGS. 5 and 18, a recessed area 48 may be positioned between the bottom edge 46 and the side portion 28 of the shell 22. The recessed area 48 may be closer to a center of the helmet 20 than at least one of the bottom edge 46 and the side portion 28. In some embodiments, the recessed area extends around the helmet 20 along the bottom edge 46. The recessed area 48 may be closer to the center of the helmet 20 than the bottom edge 46 or the side portion 28. A rim 47 may extend along the bottom edge 46 of the shell 22. The recessed area 48 may be closer to the center of the helmet 20 than the rim 47 of the side portion 28. A ridge 101 (FIG. 18) may separate the recessed area 48 from the side portion 28. The ridge 101 may form a ledge that overhangs the recessed area 48. The ridge 101 may have a ridge height that is the distance that the ridge extends away from the recessed area 48. The ridge 101 may be positioned between the bottom edge 46 of the shell 22 and an ear opening 99.

Referring to FIGS. 7-10, the helmet 20 may include a liner 54 configured to reduce the force felt by a user when the shell 22 is impacted. The liner may also be referred to as a bonnet or matrix. One or more central pads 50 may be coupled to the liner 54. The central pad 50 may be coupled to or adjacent the central portion 26. Examples of pads that are contemplated for use with the helmet 20 is described in U.S. Pat. Nos. 7,895,618, 8,814,150, 8,950,735, and 7,774,866. The helmet 20 may include a central thickness $T_C$ (FIG. 8) as measured from an inner surface 52 of the central pad 50 to an outer surface of the central portion 26.

Figure 8:
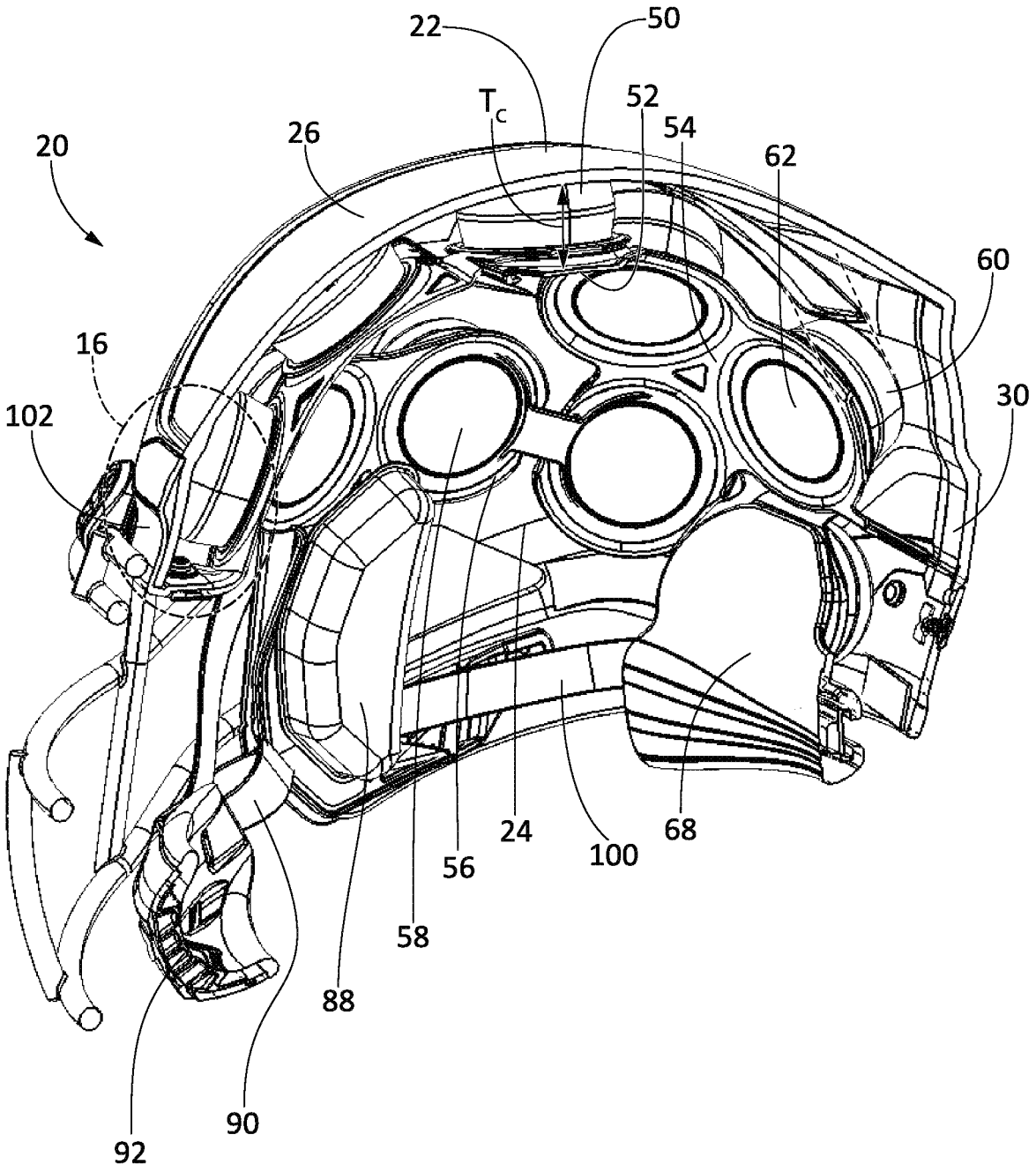
FIG. 8 is a sectional view of the helmet of FIG. 1 along a plane defined by line 8-8 in FIG. 6.
Figure 9:
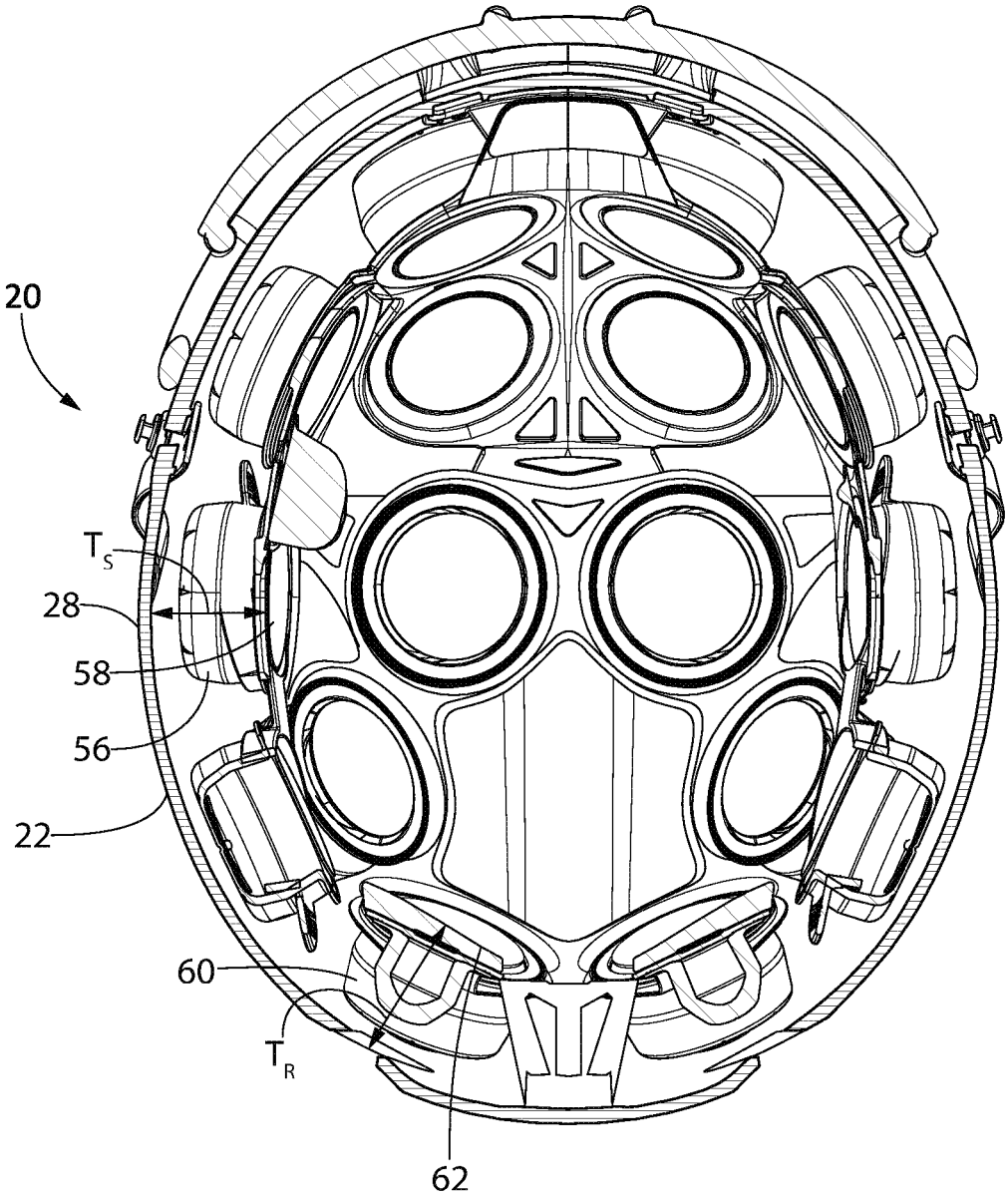
FIG. 9 is a sectional view of the helmet of FIG. 1 along a plane defined by line 9-9 in FIG. 5.

Referring to FIGS. 8-9, one or more side pads 56 may be coupled to the liner 54. The side pad 56 may be coupled to the side portion 28. The helmet 20 may include a side thickness $T_S$ as measured from an inner surface 58 of the side pad 56 to an outer surface of the side portion 28. One or more rear pads 60 may be coupled to the liner. The rear pad 60 may be coupled to the rear portion 30. The helmet 20 may include a rear thickness $T_R$ as measured from an inner surface 62 of the rear pad 60 to an outer surface of the rear portion 30 (FIG. 8). In some embodiments, the central thickness $T_C$ is less than the side thickness $T_S$. In some embodiments, the central thickness $T_C$ is less than the rear thickness $T_R$. In some embodiments, the central thickness $T_C$ is less than each of the side thickness $T_S$ and the rear thickness $T_R$. The central thickness $T_C$ may be about 10 millimeters to about 60 millimeters, about 10 millimeter to about 15 millimeters, about 15 millimeters to about 20 millimeters, about 20 millimeters to about 25 millimeters, about 25 millimeters to about 30 millimeters, about 30 millimeters to about 35 millimeters, about 35 millimeters to about 40 millimeters, about 40 millimeters to about 45 millimeters, about 45 millimeters to about 50 millimeters, about 50 millimeters to about 55 millimeters, or about 55 millimeters to about 60 millimeters. The side thickness $T_S$ may be about 10 millimeters to about 60 millimeters, about 10 millimeter to about 15 millimeters, about 15 millimeters to about 20 millimeters, about 20 millimeters to about 25 millimeters, about 25 millimeters to about 30 millimeters, about 30 millimeters to about 35 millimeters, about 35 millimeters to about 40 millimeters, about 40 millimeters to about 45 millimeters, about 45 millimeters to about 50 millimeters, about 50 millimeters to about 55 millimeters, or about 55 millimeters to about 60 millimeters. The rear thickness $T_R$ may be about 10 millimeters to about 60 millimeters, about 10 millimeter to about 15 millimeters, about 15 millimeters to about 20 millimeters, about 20 millimeters to about 25 millimeters, about 25 millimeters to about 30 millimeters, about 30 millimeters to about 35 millimeters, about 35 millimeters to about 40 millimeters, about 40 millimeters to about 45 millimeters, about 45 millimeters to about 50 millimeters, about 50 millimeters to about 55 millimeters, or about 55 millimeters to about 60 millimeters.

In some embodiments, the helmet 20 includes a single liner 54 and each of the central pad 50, side pad 56, and rear pad 60 are coupled to the liner 54. In other embodiments, the helmet 20 includes more than one liner 54 and one or more of the central pad 50, side pad 56, and rear pad 60 are coupled to each liner 54. In some embodiments, the central pad 50, side pad 56, and rear pad 60 are fixed to the liner 54. In other embodiments, at least one of the central pad 50, side pad 56, and rear pad 60 are detachably coupled to the liner. The liner 54 may be coupled to the shell 22 (e.g., via adhesive, ultrasonic weld, or fastener). The liner 54 may include a strap 64 (FIG. 10) having a fastener 66 configured to be coupled to the shell 22. In some embodiments, the fastener 66 is coupled to the shell 22 using existing holes in the shell 22 for a chin protector, as explained in greater detail below.

Figure 12:
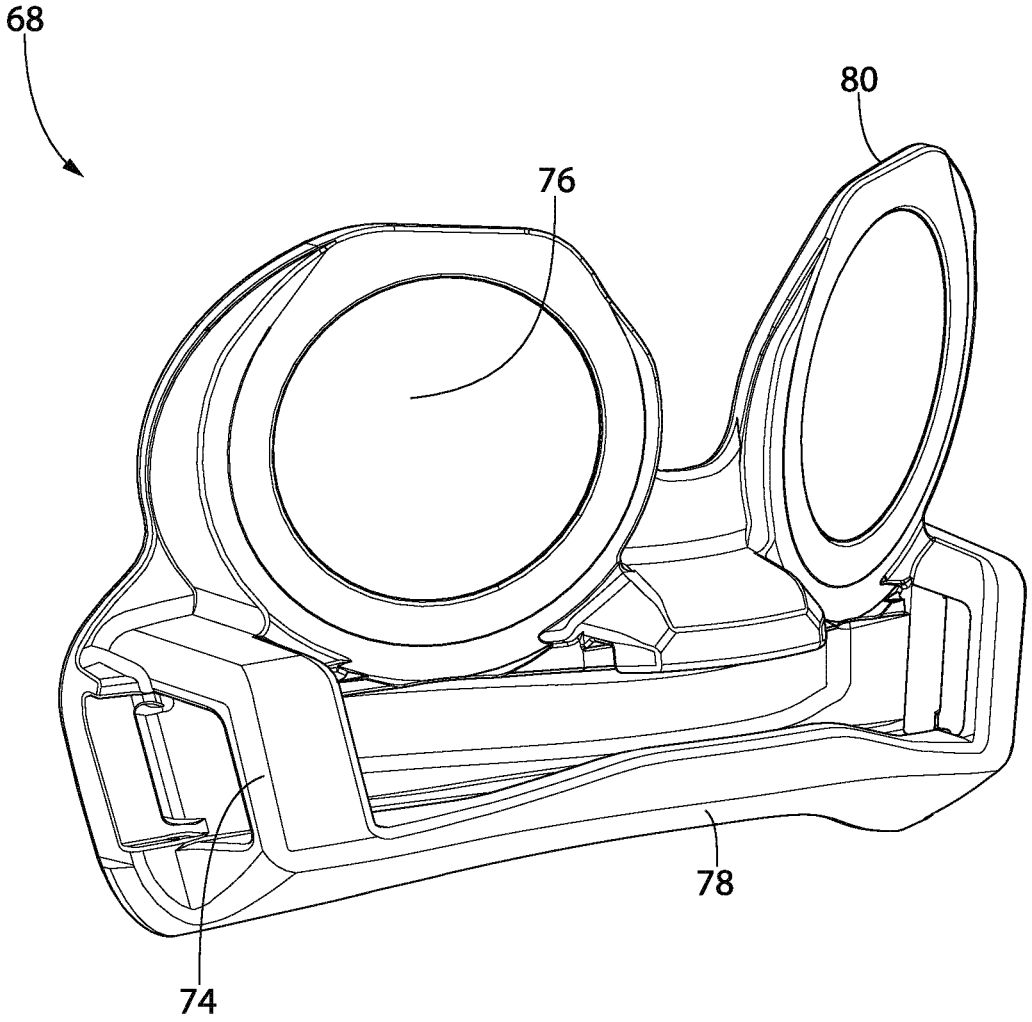
FIG. 12 is a rear perspective view of the plate of FIG. 1.
Figure 13:
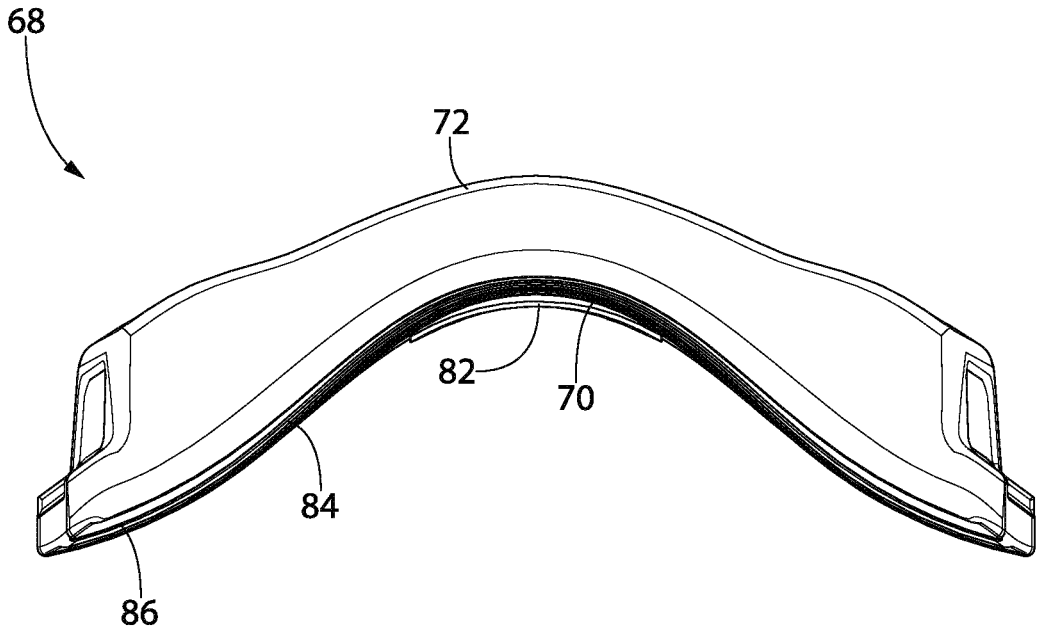
FIG. 13 is a bottom plan view of the plate of FIG. 1.

Referring to FIGS. 8 and 11-13, the helmet 20 may include a plate 68 configured to prevent the bottom edge 46 of the shell 22 from contacting a user's neck when the user's neck is arched back. The plate 68 may extend below the bottom edge 46 of the shell 22. The plate 68 may be padded. An inner surface 70 of the plate 68 may be curved to generally follow the contour of a user's neck (FIG. 13). The inner surface 70 may include a first curve 82, a second curve 84, and a third curve 86. The first curve 82 may be selected such that portions of the plate 68 contact a user's neck but the plate 68 does not contact a user's spine. The second curve may be selected such that the plate 68 generally follows the contours of a user's neck next to the spine. The third curve 86 may be selected such that the ends of the plate 68 are flared to prevent undesired contact between the end of the plate and the user's neck. A rear surface 72 of the plate 68 may be curved to generally follow the contour of the cavity 24 defined by the shell 22.

The plate 68 may be coupled to the liner 54. The plate 68 may include a receiver 74 (FIG. 12) configured to be coupled to a suspension system, as explained in greater detail below. The receiver 74 may be a loop configured to receive a strap or belt. The plate 68 may be positioned between the user's head and the rear pad 60. The plate 68 may include a receiving area 76 having a shape generally similar to the rear pad 60 such that the plate 68 overlaps the rear pad 60 and the rear pad 60 helps secure the position of the plate 68. The plate 68 may be configured to protect the base of the skull and the neck. The bottom 78 of the plate 68 may be the thickest portion of the plate 68 as measured between the inner surface 70 and rear surface 72. The plate 68 may be tapered such that the bottom 78 of the plate is the thickest portion and the top 80 of the plate is the thinnest portion. The top of the plate 68 may have a thickness of about 1 millimeter to about 25 millimeters, about 1 millimeter to about 5 millimeters, about 5 millimeters to about 10 millimeters, about 10 millimeters to about 15 millimeters, about 15 millimeters to about 20 millimeters, about 20 millimeters to about 25 millimeters, or about 25 millimeters to about 30 millimeters. The bottom of the plate 68 may have a thickness of about 5 millimeters to about 35 millimeters, about 1 millimeter to about 5 millimeters, about 5 millimeters to about 10 millimeters, about 10 millimeters to about 15 millimeters, about 15 millimeters to about 20 millimeters, about 20 millimeters to about 25 millimeters, about 25 millimeters to about 30 millimeters, or about 30 millimeters to about 35 millimeters.

Referring to FIG. 8, the helmet 20 may include a jaw pad 88 configured to be adjacent a user's jaw (e.g., upper jaw, lower jaw, or both upper and lower jaws) when the helmet 20 is on the user's head. In some embodiments, the jaw pad 88 is coupled to the shell 22. In other embodiments, the jaw pad 88 is coupled to the liner 54. The jaw pad 88 may be the thickest pad of the helmet 20. The jaw pad 88 may be detachably coupled to the liner 54 or shell 22. A kit may include a plurality of jaw pads 88 having different thickness to provide a snug fit between the shell 22 and the user's jaw.

Referring to FIGS. 2, 8, 10, and 18, the helmet 20 may include a suspension system 90 configured to secure the helmet 20 on a user's head in a desired position and orientation. The suspension system 90 may include one or more of a chin protector 92, the liner 54, and the plate 68. The chin protector 92 may be configured to protect a user's chin from impact. The chin protector 92 may include a rigid outer surface and a padded inner surface. The chin protector 92 may be coupled to the shell 22 by a first connector 94 and a second connector 96. The first connector 94 and/or the second connector 96 may be a strap. Each of the first connector 94 and the second connector 96 may include a fastener 98 configured to be coupled to the shell 22. The fastener 98 on the first connector 94 may be coupled to the shell 22 via the same opening used to couple the fastener 66 of the liner 54. The fastener 98 on the second connector 96 may be coupled to the shell 22 in the recessed area 48. The fastener 98 and strap 94 may extend away from the recessed area 48 by a fastener distance. The ridge distance that the ridge 101 extends away from the recessed area 48 may be at least about 1% to about 10%, about 10% to about 20%, about 20% to about 30%, about 30% to about 40%, about 40% to about 50%, about 50% to about 60%, about 60% to about 70%, about 70% to about 80%, about 80% to about 90%, or about 90% to about 100% of the fastener distance. The fastener 98 coupled to the recessed area 48 may reduce the chance of the fastener 98 snagging on other players or equipment. The liner 54 may include a second fastener that is coupled to the shell 22 in the same opening as the fastener 98 of the second connector 96.

Figure 10:
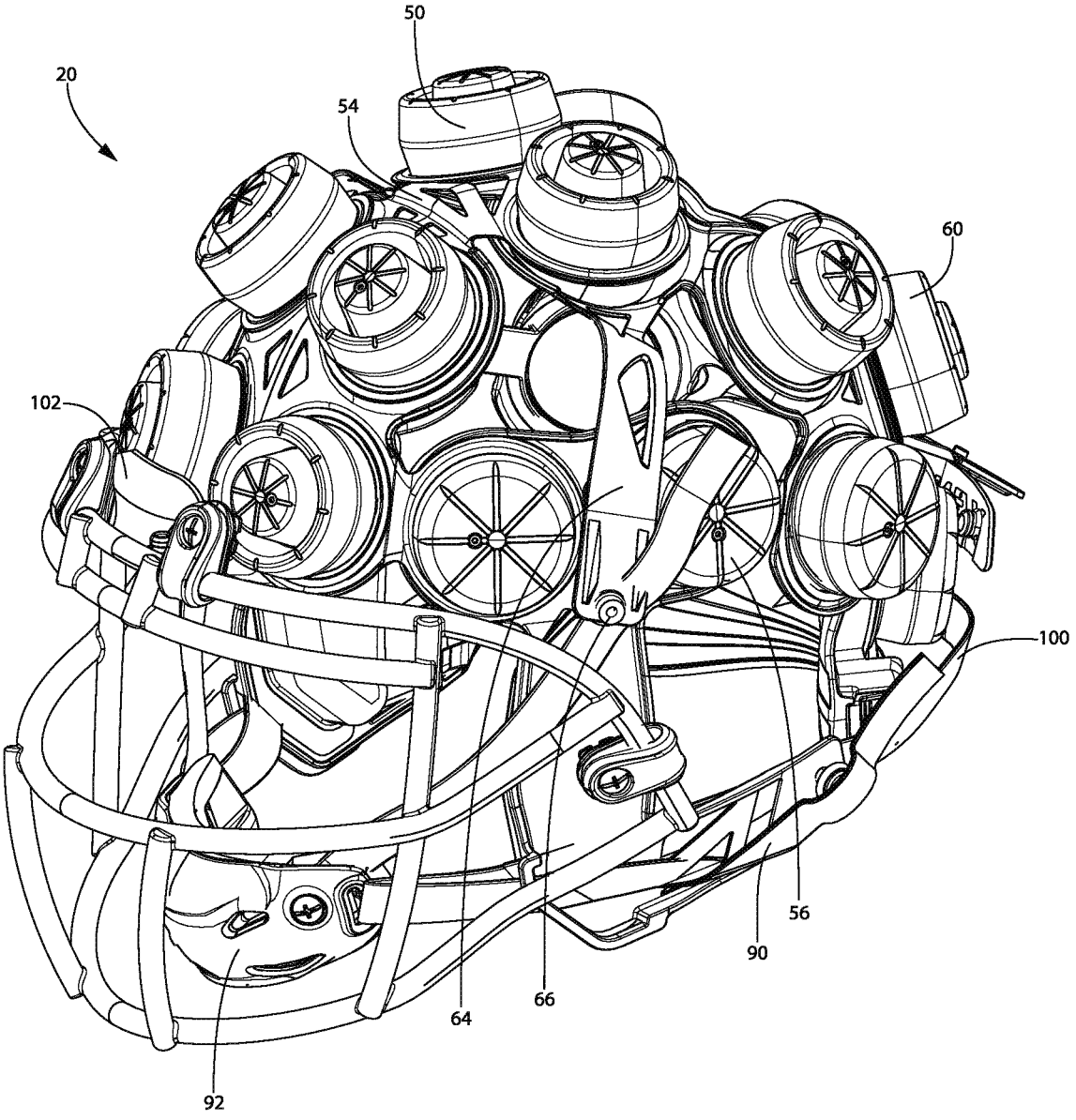
FIG. 10 is a side perspective view of the helmet of FIG. 1 with the shell removed.
Figure 11:
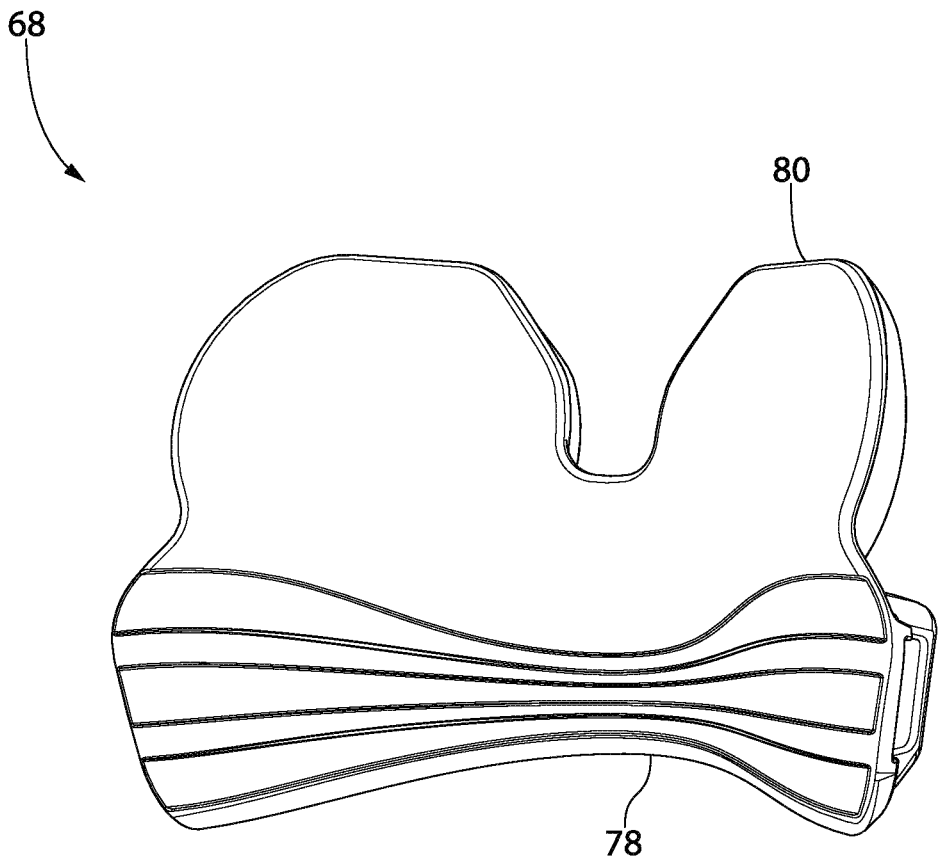
FIG. 11 is a front perspective view of the plate of FIG. 1.

Referring to FIGS. 8 and 10, the suspension system 90 may include a base strap 100 configured to extend around at least a portion of the helmet 20. The base strap 100 may be coupled to each of the chin protector 92 and the plate 68. The base strap 100 may be configured to be positioned in the receiver 74 of the plate 68 (FIG. 12). The second connector 96 and the base strap 100 may be a unitary construct such that as the second connector 96 is tightened, the base strap 100 is cinched, thereby securing the chin protector 92 and the plate 68 on the user's neck and chin. The chin protector 92 and the base strap 100 may at least partially encircle a user's head or neck when the helmet 20 is worn. The liner 54 may be coupled to the shell 22 via strap 64 such that the pads (e.g., central pad 50, side pad 56, or rear pad 60) are in contact with an interior of the shell 22. One or more pads (e.g., central pad 50, side pad 56, or rear pad 60) may move out of contact with the interior of the shell 22 as the base strap 100 is tightened while strap 64 remains coupled to the shell 22. A portion of the base strap 100 may be positioned between the jaw pad 88 and the shell 22.

Figure 16:
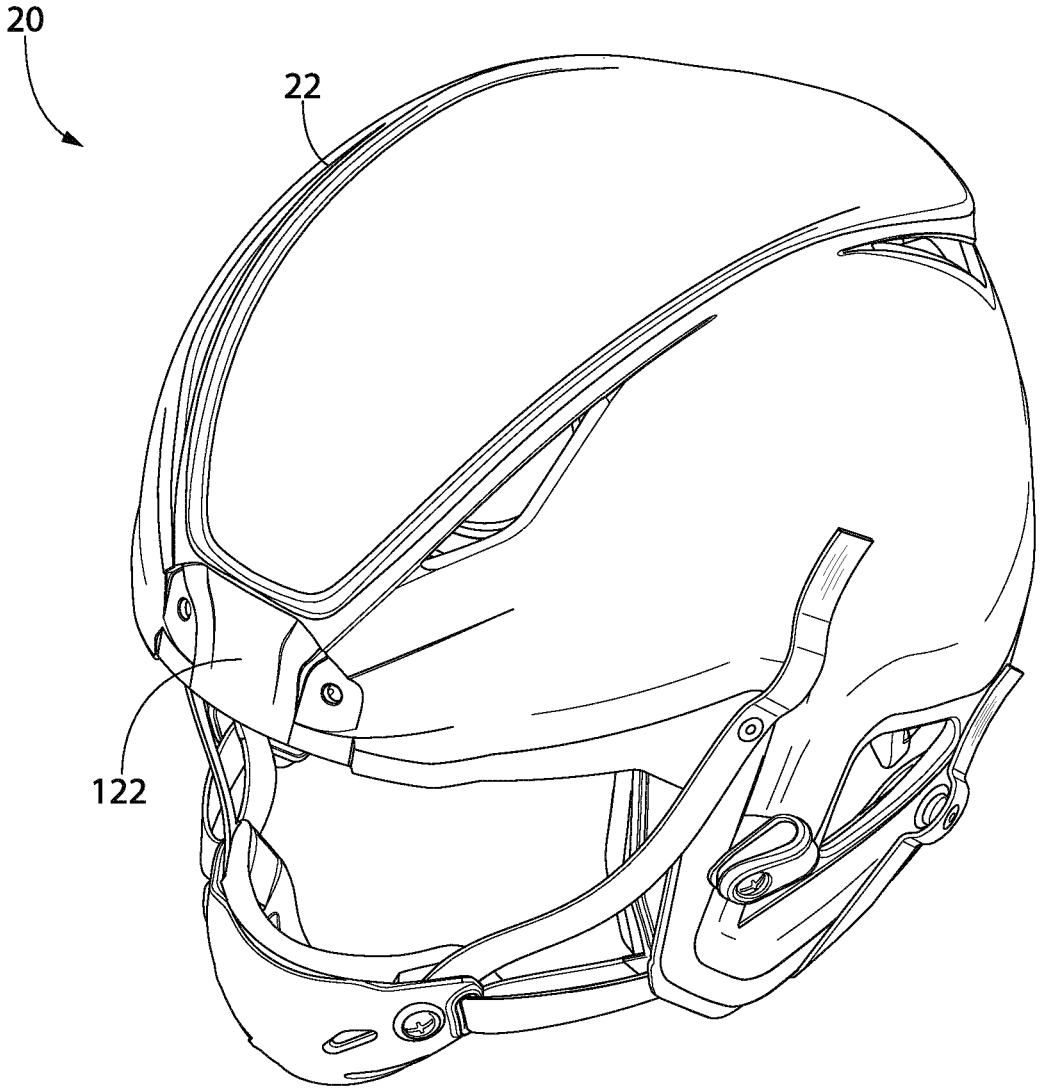
FIG. 16 is a front perspective view of the helmet of FIG. 1 with the facemask and front bumper removed.

Referring to FIGS. 1, 8, and 14-17, the helmet 20 may include a front bumper 102. The front bumper 102 may wrap around an edge (e.g. a front edge) of the shell 22. The front bumper 102 may extend from within the cavity 24 of the shell 22 and onto an outer surface of the shell 22. The shell 22 may include a receiving area 122 for the front bumper 102 (FIG. 16). The receiving area 122 may be recessed compared to an adjacent portion or portions of the shell 22. At least a portion of the front bumper 102 may be flush with an outer surface of the shell 22 when the front bumper 102 is within the receiving area 122 as explained in greater detail below.

Figure 14:
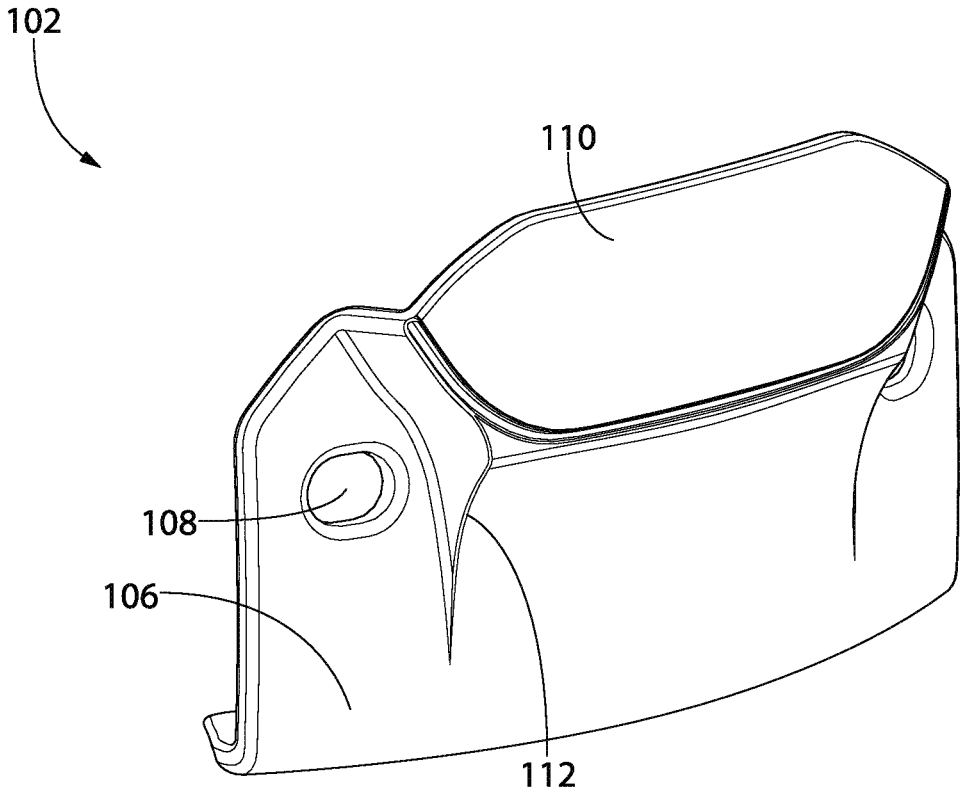
FIG. 14 is a front perspective view of the front bumper of FIG. 1.
Figure 15:
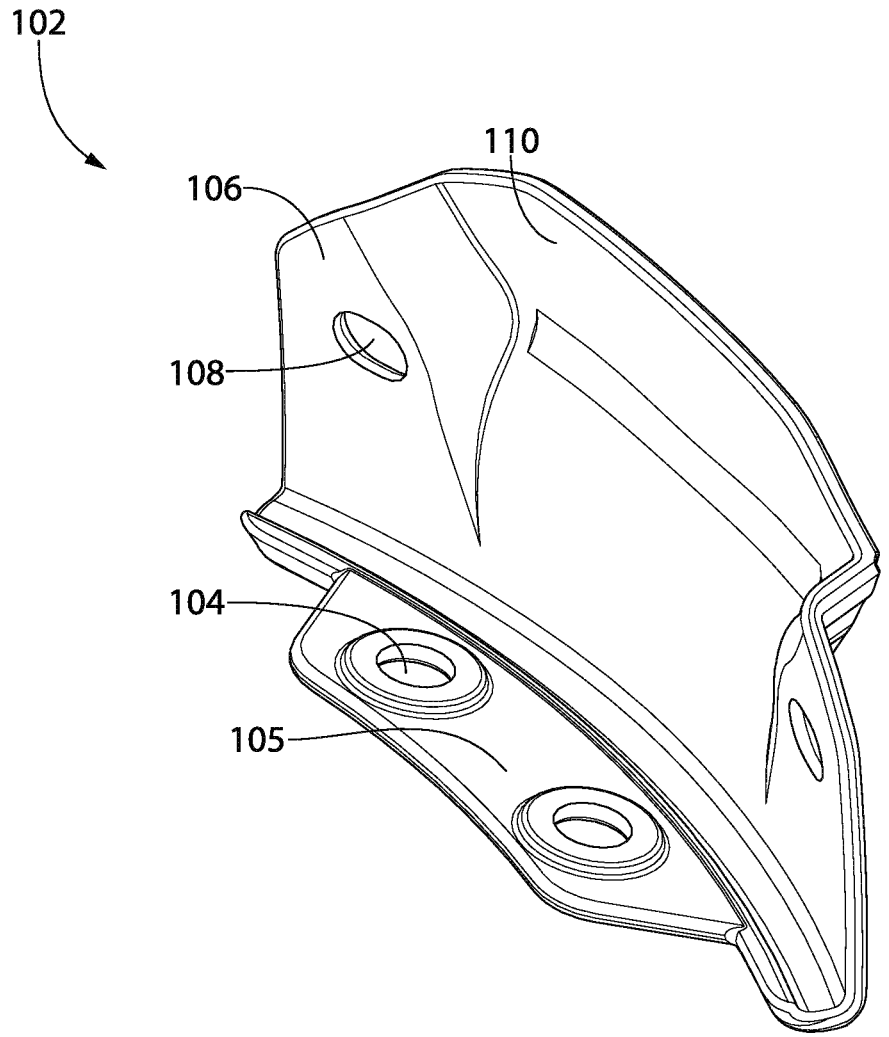
FIG. 15 is a rear perspective view of the front bumper of FIG. 1.

Referring to FIGS. 8 and 14-17, the front bumper 102 may include a base 106 configured to be positioned on or adjacent the front 36 of the shell 22. The base 106 may include openings 108 configured to receive a fastener 115 (e.g., threaded connector, hook and loop fastener, or rivet) to couple the front bumper 102 to the shell 22. Assembling the helmet 20 may include coupling the front bumper 102 to the shell 22 before coupling the liner 54 to the shell. Coupling the front bumper 102 to the shell 22 before the liner 54 may allow a user to access the inner portion of fastener 115 (FIG. 17) without the fastener 115 being obstructed by the liner 54. A body 110 may protrude from the base 106. The base 106 may be positioned against the shell 22 but the body 110 may be spaced from the shell 22 such that the body 110 may resiliently deform when impacted, thereby reducing the force of impact felt by the user. The transition between the base 106 and the body 110 may be defined by an arc 112 (FIG. 14).

Referring to FIGS. 8 and 14-17, the front bumper 102 may be coupled to the liner 54. In some embodiments, the front bumper 102 is detachably coupled (e.g., via snap fit or hook and loop fastener) to the liner 54. The front bumper 102 may include an aperture 104 configured to receive a connector 107 (FIG. 17) to couple the front bumper 102 to the liner 54. The front bumper 102 may include a flange 105. Aperture 104 may extend through the flange 105. The liner 54 may include a liner plate 124 (FIG. 17) that includes an aperture to receive fastener 107. The front bumper 102 may be fixed to the liner 54 with fastener 107. The liner 54 may be coupled to the front bumper 102 after the front bumper 102 is coupled to the shell 22. The liner 54 may be detachable from the front bumper 102 and the shell 22 while the front bumper 102 is coupled to the shell 22. The front bumper 102 may be coupled directly to the shell 22. The front bumper 102 may be a different color than the shell 22. The color of the front bumper 102 and shell 22 may be selected to follow a desired color scheme. The front bumper 102 may be commercially available separately from the shell 22.

Figure 17:
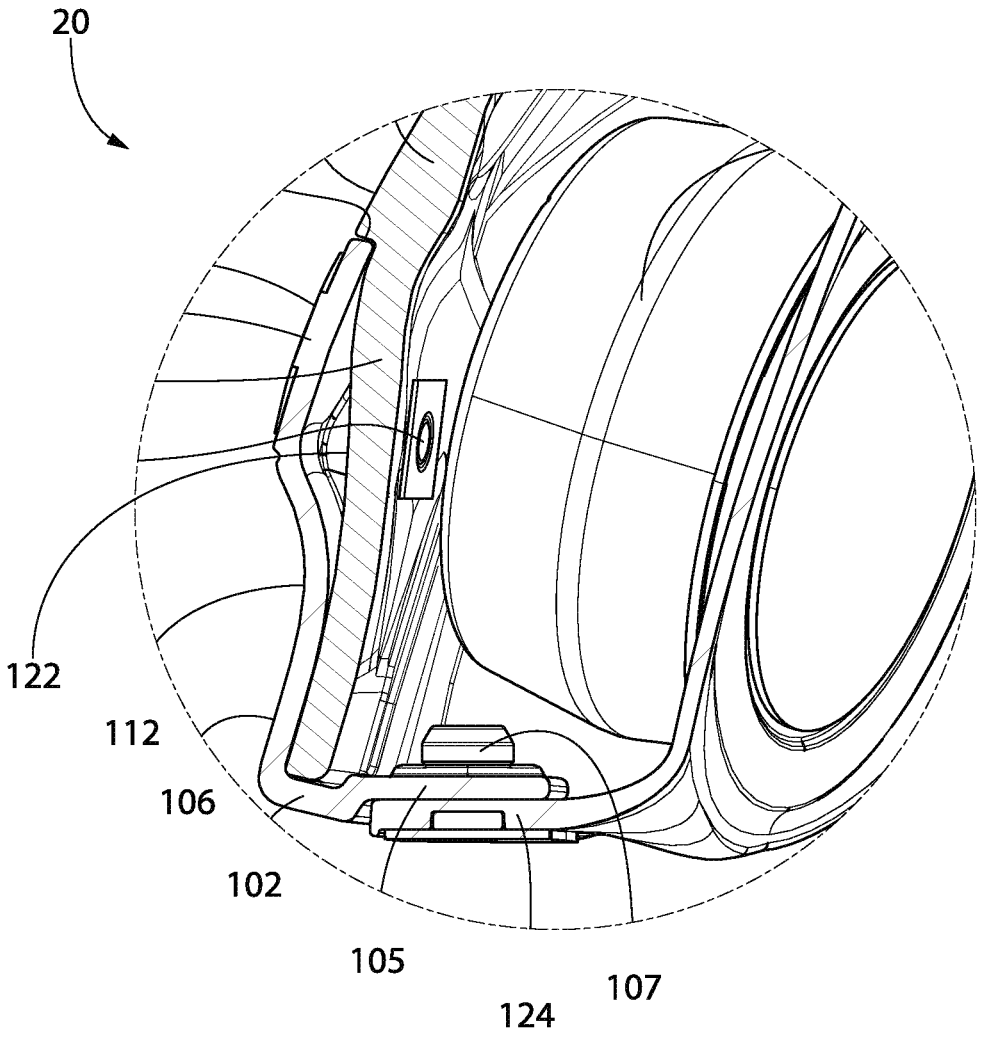
FIG. 17 is an enlarged view of a portion of the helmet of FIG. 8.

Referring to FIG. 17, the shell 22 may include an extension 118. The extension 118 may define at least a portion of the receiving area 122 for the front bumper 102. The receiving area 122 may be positioned between the central portion 26 and a lower rim of the front of the helmet 20. The base 106 of the front bumper 102 may be positioned adjacent or in contact with the outer surface of the receiving area 122. The extension 118 may be positioned closer to the center of the helmet 20 than other portions of the shell 22 (e.g., central portion 26). An outer surface of the receiving area 122 may be recessed compared to an outer surface 23 of the shell 22. A shoulder 120 may be formed where the shell 22 meets the extension 118. The shoulder 120 may have a thickness similar to, or the same as, the body 110. The shoulder 120 may be sized such that an outer surface 116 of the body 110 is flush with, or recessed compared to, the outer surface 23 (e.g., front surface) of the shell 22 when the front bumper 102 is coupled to the shell 22. The front bumper 102 may be positioned within the receiving area 122 such that an outer surface 116 of the front bumper 102 may be recessed toward a center of the shell 22 compared to an outer surface of the receiving area 122. A body 110 that is flush with the outer surface 23 of the shell 22 may reduce the likelihood of the front bumper 102 snagging on another player or equipment. A top edge of the front bumper 102 may abut an edge of the receiving area 122. The top edge of the front bumper 102 may be spaced from the edge of the receiving area 122.

Figure 3:
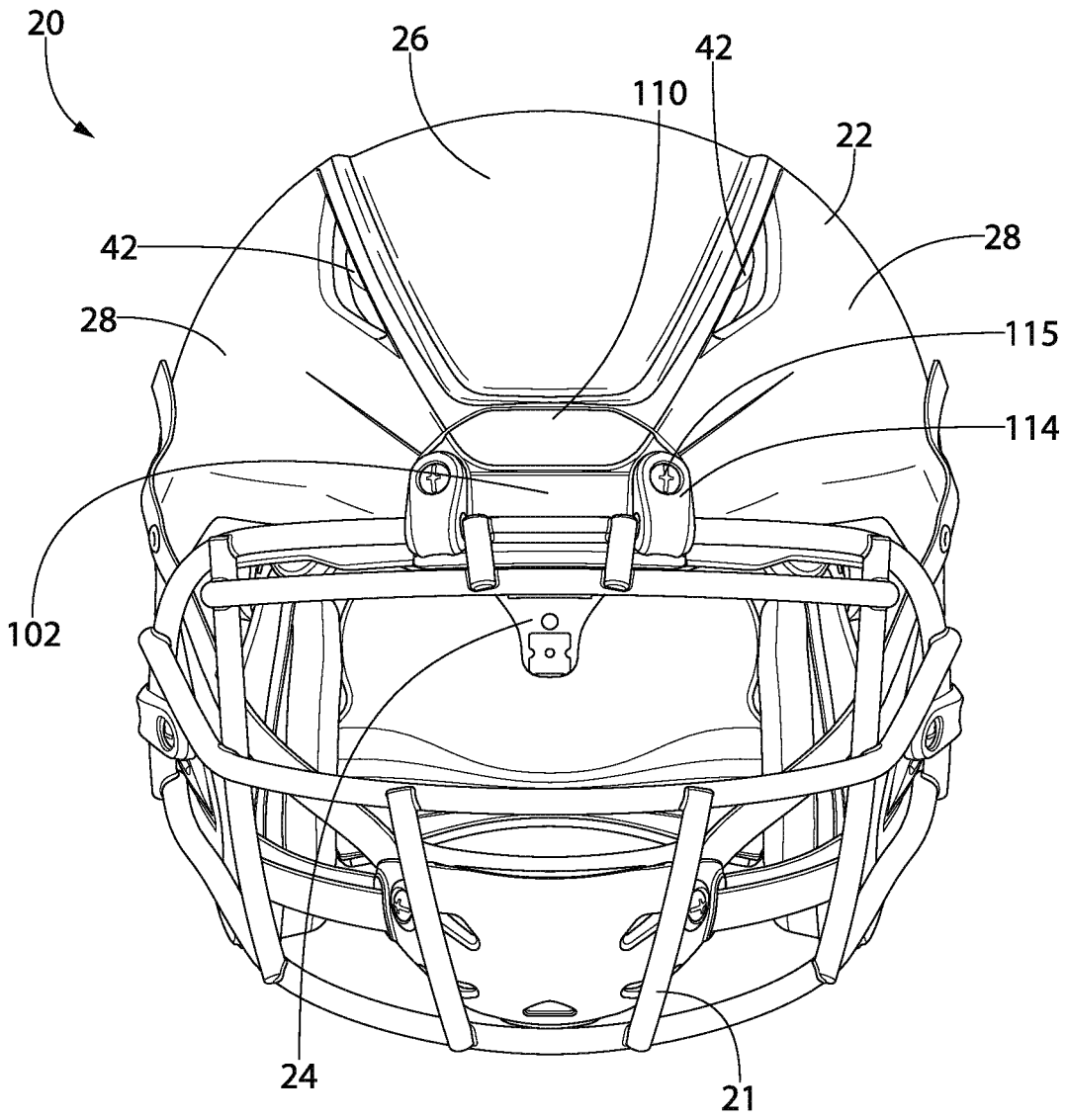
FIG. 3 is a front elevation view of the helmet of FIG. 1.

The helmet 20 may include a facemask 21 coupled to the shell 22. Referring to FIGS. 1 and 3, the helmet 20 may include a coupler 114 (e.g., a clip) configured to secure the facemask 21 to the shell 22. The coupler 114 may be coupled positioned on the base 106 of the front bumper 102 adjacent the body 110. The front surface of the body 110 protruding away from the base 106 may provide a recess configured to receive the coupler 114. The recess may reduce or eliminate unwanted snagging or contact of the coupler 114 on other players or equipment. The coupler 114 may be coupled to the shell 22 by fastener 115. The facemask 21 and front bumper 102 may be coupled to the shell 22 with fastener 115 before the liner 54 is coupled to the shell 54.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. A helmet comprising:

a shell defining a cavity configured to receive a user's head, the shell including an exterior shell surface and a receiving area recessed into exterior shell surface;

a liner within the cavity and coupled to the shell;

a facemask coupled to the shell; and a front bumper coupled to the shell and positioned at least partially within the receiving area of the shell, wherein the front bumper is positioned within the receiving area such that an outer surface of the front bumper is generally flush with the exterior shell surface.

2. The helmet of claim 1, wherein the shell includes a first ridge and a second ridge extending away from a rear surface of the shell, wherein a rearmost point of the first ridge and a rearmost point the second ridge lie within a reference plane that is rearwardly spaced from the rear surface of the shell when the helmet is resting on a horizontal surface.

3. The helmet of claim 2, wherein each end of the first ridge is curved upwardly toward a top of the shell and each end of the second ridge is curved downward toward a bottom of the shell.

4. The helmet of claim 2, wherein the shell includes a first opening proximate each end of the first ridge and a second opening proximate each end of the second ridge.

5. The helmet of claim 4, wherein the first openings and the second openings are arranged to form a generally X-shaped pattern.

6. The helmet of claim 1, wherein the front bumper is coupled to the shell and the liner and the front bumper extends from within the cavity to an exterior of the shell.

7. The helmet of claim 1, wherein the front bumper is positioned within the receiving area such that an outer surface of the front bumper is recessed toward a center of the shell relative to the exterior shell surface.

8. The helmet of claim 1, wherein the front bumper includes a recess configured to receive at least a portion of the facemask.

9. The helmet of claim 1, wherein the front bumper is positioned within the receiving area such that a top edge of an outer surface of the front bumper is flush with a top edge of the receiving area.

10. The helmet of claim 1, wherein the front bumper abuts an edge of the receiving area.

11. The helmet of claim 1, wherein the front bumper is spaced from an edge of the receiving area.

12. The helmet of claim 1, wherein the front bumper is detachably coupled to each of the shell and the liner.

13. The helmet of claim 1, wherein the exterior shell surface includes a first side portion, a second side portion and a central portion extending between the first side portion and the second side portion, wherein the exterior shell surface going from the first side portion to the central portion is recessed and the exterior shell surface going from the second side portion to the central portion is recessed, wherein an apex of the central portion is the top most element of the shell when the helmet is resting on a horizontal surface.

14. The helmet of claim 1, wherein the exterior shell surface includes a rear portion, a front portion, a first side portion, a second side portion and a central portion extending from the front portion to the rear portion and between the first side portion and the second side portion, wherein a perimeter of the central portion is recessed relative to the first side portion and the second side portion proximate the front portion and protrudes relative to the first side portion and the second side portion proximate the rear portion.

15. The helmet of claim 1, wherein each side portion of the shell includes a recessed area, the helmet further comprising:

a chin protector coupled to the recessed area of the shell by a chin protector fastener.

16. The helmet of claim 1, wherein the liner is detachably coupled to each of the shell and the front bumper such that the liner can be detached from the shell and the front bumper while the front bumper remains coupled to the shell.

17. The helmet of claim 1, wherein the liner is detachably coupled to the shell.

18. The helmet of claim 1, wherein the shell is comprised of nylon.

19. A football helmet comprising:

a shell defining a cavity configured to receive a user's head, the shell including a shell outer surface and a receiving area recessed into the shell outer surface;

four openings in a rear of the shell that allow the shell to flex when impacted;

a liner within the cavity and coupled to the shell;

a facemask coupled to the shell;

a chin protector including a strap coupled to a recessed area of the shell;

two rear ridges protruding from a rear surface of the shell, the two rear ridges being the rearmost element of the football helmet; and a front bumper detachably coupled to the shell and the liner, the front bumper extending from within the cavity to an exterior of the shell, the front bumper positioned at least partially within the receiving area of the shell.

20. A football helmet comprising:

a shell defining a cavity configured to receive a user's head, the shell including an exterior shell surface and a receiving area recessed into the exterior shell surface;

four openings in the rear of the shell that allow the shell to flex when impacted;

a liner within the cavity and coupled to the shell;

a facemask coupled to the shell;

a chin protector including a strap coupled to a recessed area of the shell;

two rear ridges protruding from a rear surface of the shell, the two rear ridges being the rearmost element of the football helmet; and a front bumper detachably coupled to the shell and the liner, the front bumper extending from within the cavity to an exterior of the shell, the front bumper positioned at least partially within the receiving area of the shell such that an outer surface of the front bumper is generally flush with the exterior shell surface and the front bumper abuts an edge of the receiving area, the front bumper including a recess that receives at least a portion of the facemask, wherein the exterior shell surface includes a rear portion, a front portion, a first side portion, a second side portion and a central portion extending from the front portion to the rear portion and between the first side portion and the second side portion, wherein a perimeter of the central portion is recessed relative to the first side portion and the second side portion proximate the front portion and protrudes relative to the first side portion and the second side portion proximate the rear portion, and wherein the liner is detachably coupled to each of the shell and the front bumper such that the liner can be detached from the shell and the front bumper while the front bumper remains coupled to the shell.

21. A helmet comprising:

a shell defining a cavity configured to receive a user's head, the shell including an exterior shell surface and a receiving area recessed into exterior shell surface;

a liner within the cavity and coupled to the shell;

a facemask coupled to the shell; and a front bumper coupled to the shell and positioned at least partially within the receiving area of the shell, wherein the front bumper is detachably coupled to each of the shell and the liner.

* * * * *